US008731444B2

(12) United States Patent
Ohsawa et al.

(10) Patent No.: US 8,731,444 B2
(45) Date of Patent: May 20, 2014

(54) DEVELOP ROLLER, DEVELOP UNIT, PROCESS CARTRIDGE, AND IMAGE FORMING APPARATUS

(75) Inventors: Masayuki Ohsawa, Atsugi (JP); Toshio Kojima, Isehara (JP); Kyohta Koetsuka, Fujisawa (JP); Yoshiyuki Takano, Hachioji (JP); Noriyuki Kamiya, Yamato (JP); Takashi Innami, Atsugi (JP); Takumi Terasaka, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 224 days.

(21) Appl. No.: 13/091,481

(22) Filed: Apr. 21, 2011

(65) Prior Publication Data

US 2011/0274471 A1 Nov. 10, 2011

(30) Foreign Application Priority Data

May 6, 2010 (JP) ..... 2010-106150

(51) Int. Cl.
*G03G 15/09* (2006.01)

(52) U.S. Cl.
USPC ..... 399/276; 399/279; 399/280; 399/286; 492/28; 492/30; 492/31; 492/33; 492/34; 492/35; 492/36; 492/37

(58) Field of Classification Search
USPC ..... 399/276, 280, 286; 492/28, 30, 35, 36
See application file for complete search history.

(56) References Cited

U.S. PATENT DOCUMENTS 6,810,227 B2 * 10/2004 Sakata et al. ..... 399/281
8,500,616 B2 * 8/2013 Barnes et al. ..... 492/37
8,521,071 B2 * 8/2013 Nishimura et al. ..... 399/286
8,535,116 B2 * 9/2013 Abe et al. ..... 451/34
8,565,652 B2 * 10/2013 Terasaka et al. ..... 399/276
8,588,665 B2 * 11/2013 Endo et al. ..... 399/286
2005/0111886 A1 * 5/2005 Kawano ..... 399/281
2007/0147906 A1 * 6/2007 Sakurai et al. ..... 399/286

(Continued)

FOREIGN PATENT DOCUMENTS

CN 101382761 A 3/2009
JP 2003-255692 9/2003

(Continued)

OTHER PUBLICATIONS

Machine translation of (JP 2007-114317 A); by Furuya, Nobumasa; Hirata, Hiroshi; Kato, Masanori; Tanaka, Shigeru; Okamoto, Tetsuji; Kubo, Shusaku; Sumita, Toshihisa; Ozawa, Hideaki; Kaede, Naoyuki; and Iwata, Hisaya; published May 10, 2007.*

(Continued)

*Primary Examiner* — David Gray
*Assistant Examiner* — Geoffrey Evans
(74) *Attorney, Agent, or Firm* — Cooper & Dunham LLP

(57) ABSTRACT

A develop roller includes a magnet roller, and a develop sleeve containing the magnet roller and comprising a plurality of depressions in an elliptic shape regularly arranged with an interval in a longitudinal direction on a surface onto which developer is attracted by a magnetic force of the magnet roller, wherein the depressions are arranged such that a longitudinal direction of the depressions is intersected with the longitudinal direction of the develop sleeve, and a downstream side of the depressions are formed to be deeper than an upstream side in a rotary direction of the develop sleeve.

11 Claims, 12 Drawing Sheets

(56) References Cited

U.S. PATENT DOCUMENTS

| | | | | |
|---|---|---|---|---|
| 2008/0232865 | A1 | 9/2008 | Terashima et al. | |
| 2009/0060591 | A1 | 3/2009 | Kojima et al. | |
| 2010/0158578 | A1* | 6/2010 | Kojima et al. | 399/276 |
| 2011/0194874 | A1* | 8/2011 | Masuda et al. | 399/254 |
| 2012/0057907 | A1* | 3/2012 | Taguchi et al. | 399/276 |
| 2012/0294655 | A1* | 11/2012 | Terasaka et al. | 399/279 |
| 2013/0058685 | A1* | 3/2013 | Juri et al. | 399/286 |
| 2013/0095343 | A1* | 4/2013 | Arsene et al. | 428/600 |
| 2013/0108328 | A1* | 5/2013 | Ariizumi | 399/276 |
| 2013/0209143 | A1* | 8/2013 | Endou et al. | 399/284 |
| 2013/0216276 | A1* | 8/2013 | Ogawa et al. | 399/284 |
| 2013/0216277 | A1* | 8/2013 | Endou et al. | 399/284 |
| 2013/0243499 | A1* | 9/2013 | Ishikura et al. | 399/284 |

FOREIGN PATENT DOCUMENTS

| | | | |
|---|---|---|---|
| JP | 2004-191835 | | 7/2004 |
| JP | 2007-86091 | | 4/2007 |
| JP | 2007-93705 | | 4/2007 |
| JP | 2007-114317 | | 5/2007 |
| JP | 2009-80447 | | 4/2009 |
| JP | 2011013253 | A * | 1/2011 |

OTHER PUBLICATIONS

English machine translation of Kamiya et al. (JP 2011-013253 A); "Developing Roller, Developing Device, Process Cartridge and Image Forming Apparatus"; published Jan. 20, 2011; by Kimiya, Noriyuki et al.*

Chinese official action dated Jan. 10, 2013 in connection with corresponding Chinese patent application No. 201110117271.1.

* cited by examiner

5th, 6th EXAMPLES

3rd, 4th EXAMPLES

1st, 2nd EXAMPLES

1st, 2nd COMPARISONS

FIG.17A
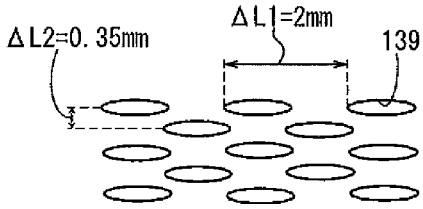
FIG.17B
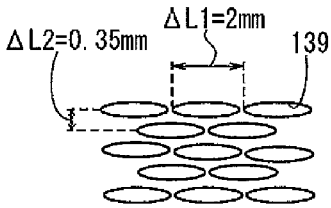
FIG.18
| | END MILL ANGLE | INTERVAL OF DEPRESSIONS | RESULTS | | |
|---|---|---|---|---|---|
| | | | INITIAL DENSITY | DECREASE IN DENSITY | DEVELOPER SEPARATION |
| 1st COMPARISON | 0 | 2 | B | C | C |
| 2nd COMPARISON | 0 | 1 | B | C | B |
| 1st EXAMPLE | 10 | 2 | B | B | A |
| 2nd EXAMPLE | 10 | 1 | A | A | A |
| 3rd EXAMPLE | 30 | 2 | A | A | A |
| 4th EXAMPLE | 30 | 1 | (A) | (B) | (A) |
| 5th EXAMPLE | 60 | 2 | A | A | A |
| 6th EXAMPLE | 60 | 1 | A | A | A |

DEVELOP ROLLER, DEVELOP UNIT, PROCESS CARTRIDGE, AND IMAGE FORMING APPARATUS

CROSS REFERENCE TO RELATED APPLICATION

The present application is based on and claims priority from Japanese Patent Application No. 2010-106150, filed on May 6, 2010, the disclosure of which is hereby incorporated by reference in its entirety.

BACKGROUND OF THE INVENTION

1. Field of the Invention

The present invention relates to a develop roller and a develop unit used in a copier, a facsimile machine, or a printer to deliver developer on a develop sleeve to a develop area between a photoreceptor drum and a develop sleeve, develop an electrostatic latent image on the photoreceptor drum, and generate a toner image as well as to a process cartridge and an image forming apparatus including such a develop unit.

2. Description of the Prior Art

Japanese Patent Application Publication No. 2003-255692 (Reference 1), No. 2004-191835 (Reference 2), and No. 2007-86091 (Reference 3) disclose a develop sleeve whose surface is sandblasted, grooved or processed by electromagnetic blasting in order to surely deliver developer to a photoreceptor drum.

Being sandblasted or grooved, the develop sleeve in high-speed rotation is prevented from slipping and retaining the developer, preventing a decrease in image density.

The develop sleeve can be made of any of aluminum alloy, brass, stainless steel and conductive resin. It is mostly made of aluminum alloy in terms of cost efficiency and workability. In sandblasting, an aluminum tube is extruded into a sleeve shape at high temperature and sprayed with abrasive grains under ambient temperature, thereby forming unevenness on the surface at about a roughness Rz5.0 to 15 μm, for example. The sandblasted develop sleeve can prevent slippage of developer owing to the unevenness on the surface even during high-speed rotation.

However, there is a problem with the sandblasted develop sleeve in terms of durability since the unevenness on the surface is extremely fine so that it is abraded and the surface is gone smooth as the number of prints increases with time. Accordingly, amount of developer the develop sleeve delivers decreases gradually, weakening the color of generated images. The develop sleeve can be made of a high hardness stainless steel or subjected to hardening on the surface. However, this is not desirable because of an increase in manufacture costs.

To form grooves on the surface of the develop sleeve of aluminum alloy, for example, an aluminum tube is extruded into a sleeve shape at high temperature, extracted under ambient temperature, and cut with a die. The cross-sectional shapes of grooves are generally square, V-form, or U-form, the depth thereof is about 0.2 mm from the surface and the number thereof is about 50 for a develop sleeve in outer diameter of ϕ25. The develop sleeve with the grooves can prevent slippage of developer even in high-speed rotation.

Moreover, the grooves are much larger than the unevenness formed by sandblasting and not abraded with time and do not cause a decrease in delivery amount of developer. The develop sleeve with the grooves are less abraded in long-time use than the sandblasted develop sleeve and can stably deliver developer.

However, it has a problem with this develop sleeve that image density may periodically vary or uneven pitch may occur because of a difference in delivery amount of developer between the grooves and non-groove portions. Generally, the deeper the grooves, the better the developer delivery performance but the more likely uneven pitch occurs due to a difference in develop field intensity of the grooves and the non-groove portions. With shallower grooves, toner, additives, or carrier in the developer is likely to get stuck in the grooves, largely decreasing the developer delivery performance and amount of developer attracted. Insufficient delivery attraction is likely to cause uneven pitch.

In view of solving the above problems, the develop sleeve disclosed in Reference 1 comprises grooves in depth of 0.05 mm or more and 0.15 mm or less to prevent uneven pitch and maintain developer delivery performance. However, along with improvement in image reproducibility by advanced image forming technique such as adaption of toner or carrier of smaller particle size or proximity developing, the uneven pitch is more noticeable. For example, using toner in mean volume diameter of 8.5 μm or less, due to its good image reproducibility a variation in amount of developer or uneven pitch is conspicuous.

FIGS. 19 and 20 show a prior art developer sleeve attracting developer. In the drawings developer 203 slips and decreases in amount on portions without grooves in a develop area D between a develop sleeve 200 and a photoreceptor drum 201, causing a decrease in image density and uneven pitch. It is in general necessary to deliver a large amount of developer 203 to the develop area D to acquire sufficient image density.

The develop sleeve 200 is typically rotated 1.1 to 2.5 times faster than the photoreceptor drum 201. A friction between the developer 203 passing the develop area D at high speed and the photoreceptor drum 201 rotating at relatively low speed becomes a load resistance on non-groove portions of the surface of the develop sleeve 200. As shown in FIG. 19, slippage or insufficient attraction of the developer 203 occurs on the non-groove portions of the develop sleeve 200, so that in the develop area D the amount of developer the develop sleeve 200 holds differs between the downstream and the upstream in the rotary direction. The amount on the downstream side is smaller than that on the upstream side. Meanwhile, as shown in FIG. 20, there is no slippage or insufficient attraction of the developer 203 while the grooves are passing the develop area D. Thus, developer slippage occurs periodically due to the grooves passing the develop area D, which changes an amount of the developer 203 and results in uneven pitch in due to uneven image density.

An image forming apparatus disclosed in Reference 2 uses a developer of toner in mean volume diameter 4 μm or more 8.5 μm or less and includes a develop sleeve having grooves extending in a longitudinal direction and arranged with an interval smaller than a width of a photoreceptor drum in a develop area in a moving direction. In this image forming apparatus there is always at least one sleeve groove in the develop area to prevent slippage of the developer, makes it possible to reduce a variation in amount of the developer in the develop area. Thus, even with use of such a small particle size toner as 8.5 μm or less in mean volume diameter, the apparatus can generate high-quality images with good reproducibility and less uneven pitch due to uneven image density.

However, there is a problem with this develop sleeve that since the grooves are formed by drawing an aluminum tube with a dice by cold working and finished by cutting or grinding and need be disposed with a narrower interval, there may be an increase in deviation of the depth of the grooves. The deviation in the groove depth may cause unevenness in image density.

It is possible to reduce the length of the interval or reduce the deviation in the groove depth by cutting the grooves one by one or several at a time. However, it increases the number of processing steps and manufacture costs.

The develop sleeve formed by electromagnetic sandblasting disclosed in Reference 3 can reduce a decrease in delivery amount of developer due to a degradation with time. However, the surface of the develop sleeve is randomly hit with a linear material by sandblasting so that it is difficult to set a proper processing condition in order to maintain an optimum attraction amount of the developer and elongate the longetivity of the develop sleeve. It is also difficult to increase the attraction amount of developer in view of high-quality image generation with a higher-speed machine in the future.

Furthermore, a doctor blade is provided adjacent to the develop roller to constantly adjust the thickness of the developer on the develop roller. The toner supply amount to the photoreceptor drum is adjusted by a gap (hereinafter, doctor gap) between the doctor blade and the surface of the develop roller. Irrespective of the surface shape (surface processing) of the develop roller, the develop roller may be warped by a frictional resistance of developer passing the doctor gap and a magnetic attraction of the developer. This may cause the doctor gap in the longitudinal center of the develop roller to be widened beyond both ends of the develop roller. Accordingly, a problem arises that toner supply amount in the longitudinal center of the develop roller is larger than that in both of the end portions, causing unevenness in image density in the longitudinal direction of the develop roller.

SUMMARY OF THE INVENTION

The present invention aims to provide a develop roller and a develop unit which can prevent a reduction in amount of developer to deliver due to a degradation over time and unevenness in density of images generated as well as to provide a process cartridge and an image forming apparatus incorporating such a develop unit.

According to one aspect of the present invention, a develop roller comprises a magnet roller, and a develop sleeve containing the magnet roller and comprising a plurality of depressions in an elliptic shape regularly arranged with an interval in a longitudinal direction on a surface onto which developer is attracted by a magnetic force of the magnet roller, wherein the depressions are arranged such that a longitudinal direction of the depressions is intersected with the longitudinal direction of the develop sleeve, and a downstream side of the depressions are formed to be deeper than an upstream side in a rotary direction of the develop sleeve.

BRIEF DESCRIPTION OF THE DRAWINGS

Features, embodiments, and advantages of the present invention will become apparent from the following detailed description with reference to the accompanying drawings:

FIGS. 17A, 17B show the depressions of the first and second comparisons;

FIG. 18 is a table showing test results of images generated by an image forming apparatus using the first to sixth examples and the first and second comparisons of the develop sleeve;

DETAILED DESCRIPTION OF THE PREFERRED EMBODIMENT

Figure 1:
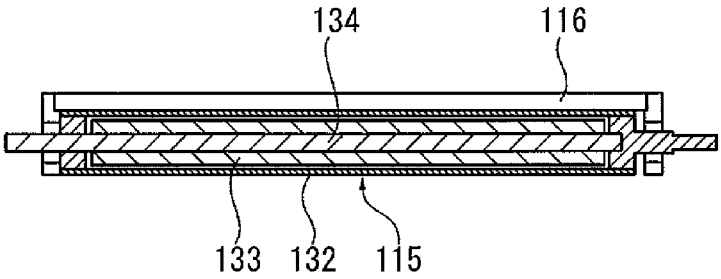
FIG. 1 cross-sectionally shows a develop roller according to one embodiment of the present invention.
Figure 2:
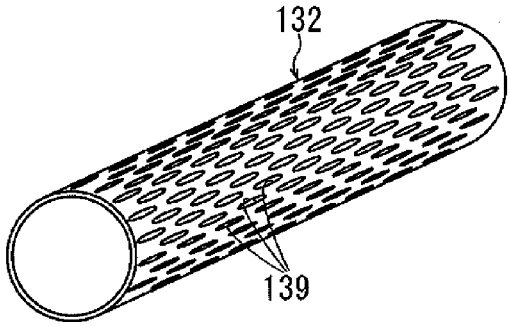
FIG. 2 is a perspective view of a develop sleeve in FIG. 1.
Figure 3:
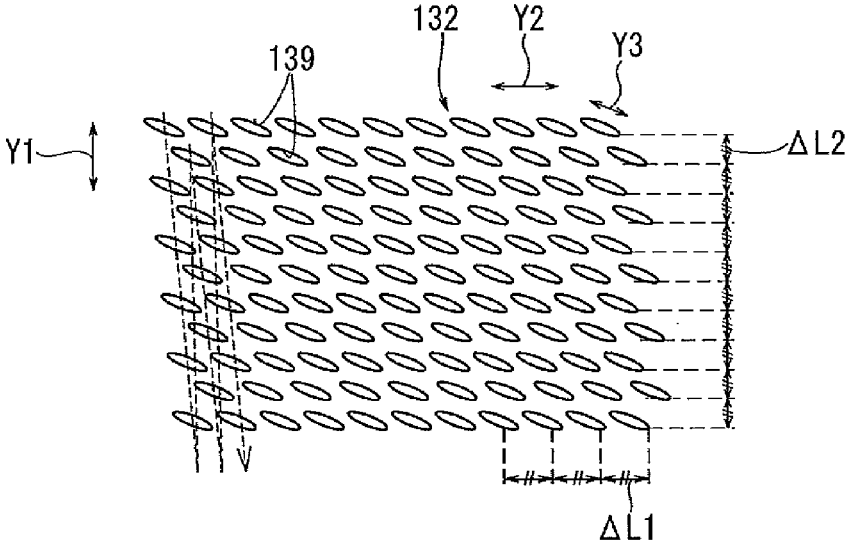
FIG. 3 is a developed view of the surface of the develop sleeve in FIG. 2.
Figure 4A:
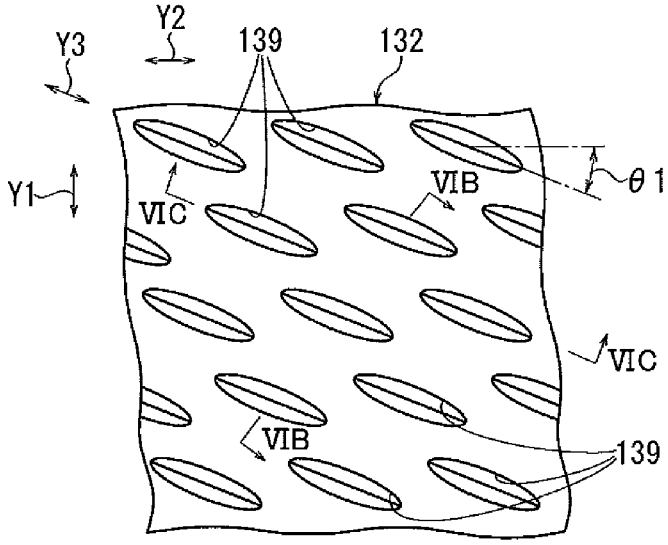
FIG. 4A is an enlarged view of a part of the develop sleeve surface in FIG. 2.
Figure 4B:
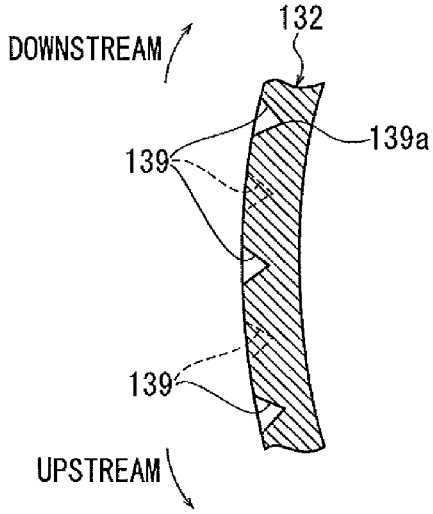
FIG. 4B is a cross section of the same along a VIB to VIB line in FIG. 4A
Figure 4C:
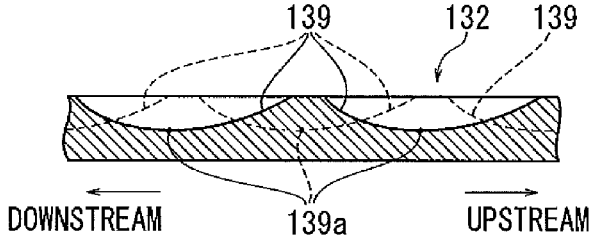
FIG. 4C is a cross section of the same along a VIC to VIC line in FIG. 4A.

Hereinafter, one embodiment of the present invention will be described in detail with reference to FIG. 1 to FIG. 9. FIG. 1 cross-sectionally shows a develop roller according to one embodiment of the present invention. FIG. 2 is a perspective view of a develop sleeve in FIG. 1. FIG. 3 is a developed view of the surface of the develop sleeve in FIG. 2. FIG. 4A is an enlarged view of a part of the develop sleeve surface in FIG. 2, FIG. 4B is a cross section of the same along a VIB to VIB line in FIG. 4A and FIG. 4C is a cross section of the same along a VIC to VIC line in FIG. 4A.

In FIG. 1 the develop roller 115 comprises a metal core 134, a cylindrical develop sleeve 132 and a magnet roller 133. The metal core 134 is parallel to a photoreceptor drum 108 in a longitudinal direction, fixed in a housing 125 of a later-described image forming apparatus 101 and does not rotate.

The magnet roller 133 is cylindrical made of a magnetic material and comprises a not-shown plurality of fixed magnetic poles. It is fixed around the metal core 134 and does not rotate.

The fixed magnetic poles are long rod-like magnets and extend in a longitudinal direction of the magnet roller 133 and are disposed on the entire outer circumference. The develop sleeve 132 contains the magnet roller 133.

One of the fixed magnetic poles faces a container 117 of developer 126 to attract the developer 126 onto the surface of the develop sleeve 132 by a magnetic force.

Another one of the fixed magnetic poles faces the photoreceptor drum 108 on which an electrostatic latent image is generated, to generate a magnetic force between the develop sleeve 132 and the develop roller 115 to thereby form a magnetic field between the develop sleeve 132 and the photoreceptor drum 108. It creates a magnetic brush by the magnetic field to deliver toner in the developer 126 attracted onto the develop sleeve 132 to the photoreceptor drum 108.

At least one fixed magnetic pole is provided between the above two fixed magnetic poles to deliver unused developer 126 to the photoreceptor drum 108 and deliver used developer 126 to the container 117 from the photoreceptor drum 108.

Chains of magnetic carrier in the developer 126 are formed on the develop sleeve 132 along magnetic field lines of this fixed magnetic pole and toner is attracted to the chains of magnetic carrier. Thus, the developer 126 is attracted onto the surface of the develop sleeve 132 by the magnetic force of the magnet roller 133.

The develop sleeve 132 being cylindrical in FIG. 2 contains the magnet roller 133, and is rotated around the axis to face the fixed magnetic poles sequentially on the inner circumference. It is made of non-magnetic materials such as aluminum alloy, brass, stainless steel (SUS) or conductive resin. The surface thereof is roughened by a surface processing device 1 (in FIG. 6A).

Aluminum alloy excels in workability and lightness and A6063, A5056 and A3003 are preferable. Among the stainless steel SUS303, SUS304 and SUS316 are preferable. The develop sleeve 132 in the drawing is made of aluminum alloy by way of example.

The outer diameter of the develop sleeve 132 is preferably about 10 mm to 30 mm and the length thereof in the axis direction is preferably about 200 mm to 350 mm.

As shown in FIGS. 2-3, 4A, 5, a large number of elliptic depressions 139 are regularly formed on the surface of the develop sleeve 132 with an interval of ΔL1 in the longitudinal direction not to overlap with each other. In the circumferential direction, rows of the depressions 139 are arranged with an interval of ΔL2. In FIGS. 3, 4A the circumferential direction of the develop sleeve 132 is indicated by the arrow Y1 and the longitudinal direction thereof is indicated by the arrow Y2.

According to the present embodiment, regularly arranging the depressions 139 refers to arranging them with the intervals of ΔL1, ΔL2 in the circumferential and longitudinal directions, respectively.

Moreover, the depressions 139 are intersected lengthwise with the develop sleeve 132 at an inclination angle of θ1. The inclination angle θ1 is set to 90 degrees or less preferably. In the drawings the longitudinal direction of the depressions 139 is indicated by the arrow Y3.

As shown in FIG. 4B, the cross sections of the depressions 139 in the width direction are in V-form and those in the longitudinal direction are arc-like curvatures as shown in FIG. 4C. The downstream side of the depression 139 is deeper than the upstream side in the rotary or circumferential direction. It gets deeper from one end and is deepest at a bottom 139*a* and gets gradually shallower after the bottom 139*a* which is closer to the downstream of the rotary direction of the develop sleeve 132.

The depressions 139 adjacent to each other in the circumferential direction of the develop sleeve 132 are shifted in position in the longitudinal direction by about a half of the length of the depression 139. Thereby, the shallow edge portions and the deep center portions of the depressions 139 are alternatively placed on the develop sleeve 132 in the circumferential direction.

Figure 6A:
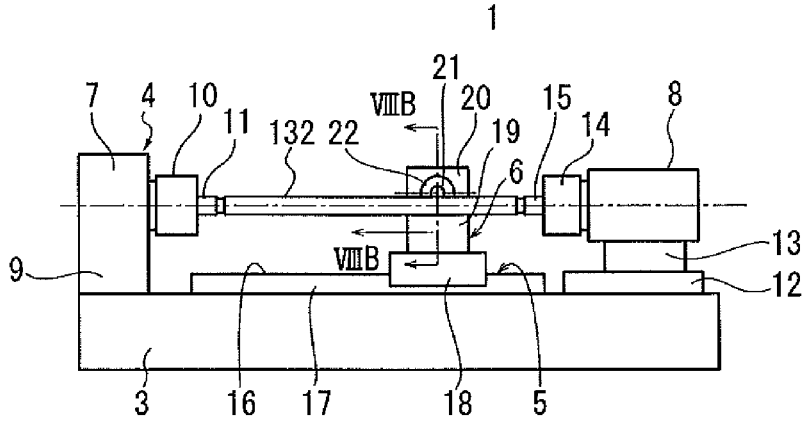
FIG. 6A is a schematic side view of a surface processing device to cut the surface of the develop sleeve in FIG. 2.

Also, the depressions 139 are helicoidally formed on the develop sleeve 132 by the surface processing device 1 in FIG. 6A, as indicated by the broken line in FIG. 3.

Figure 5:
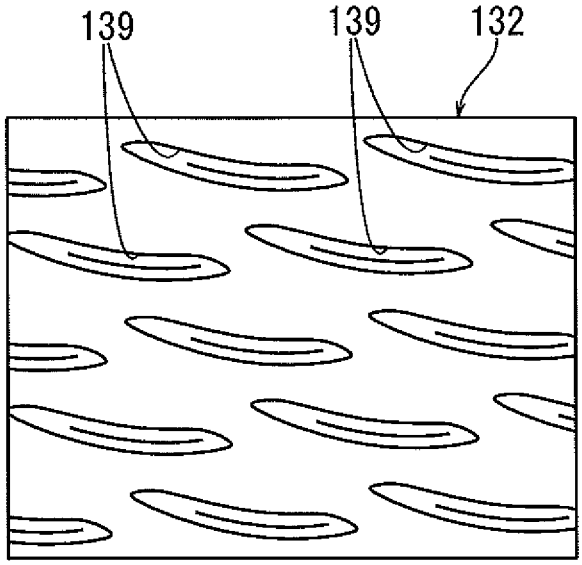
FIG. 5 is an enlarged view of a part of the develop sleeve surface in FIG. 2.

The depressions 139 are slightly curved to be arc-like in the longitudinal direction shown in FIG. 5. According to the present embodiment, the elliptic depressions can be straight in the longitudinal direction as long as they are longer in length than in width and their outer edges are curved.

The length (long diameter) of the depressions 139 is 0.3 mm or more and 2.3 mm or less while the width (short diameter) is 0.1 mm or more and 0.7 mm or less. The depth thereof is 0.02 mm or more and 0.15 mm or less. The number of the depressions 139 per 100 $m^2$ on the develop sleeve 132 is about 50 to 250 and the total volume per 100 $m^2$ is 0.5 $mm^3$ or more and 7.0 $mm^3$ or less. Further, the number of the depressions 139 per 1 mm on the photoreceptor drum 108 in the circumferential direction is 1.0 or more and 3.0 or less.

Generally, the deeper the depressions 139, the better the developer delivery performance of the develop sleeve 132 but the more likely uneven pitch occurs. The shallower the depressions 139, the less likely uneven pitch occurs but the worse the developer delivery performance. Especially, due to improved image reproducibility by progress of imaging technique, the uneven pitch is conspicuous. According to the develop sleeve 132, the depth of the depressions 139 is set to be shallow and they are disposed at a higher density, thereby achieving an improvement in the developer delivery performance and prevention of the uneven pitch.

The depressions 139 are formed on the surface of the develop sleeve 132 by the surface processing device 1 in FIG. 6A.

The surface processing device 1 in FIG. 6A comprises a base 3, a holder unit 4, a drive motor (not-shown), a tool mover 5, a tool 6 and a not-shown controller.

The base 3 is a rectangular plate and placed on the floor or table or the like so that the top face thereof is in a horizontal direction.

The holder unit 4 comprises a fixed holder 7 and a slide holder 8. The fixed holder 7 includes a fixed column 9 standing on one longitudinal end of the base 3 and a rotary chuck 10 on the fixed column 9. The rotary chuck 10 being a thick circular plate rotates around the center of the fixed column 9 and the center of the rotation is in parallel to the surface of the base 3. A chuck pin 11 stands coaxially on the middle of the rotary chuck 10.

The slide holder 8 comprises a slider 12, a slide column 13, and a rotary chuck 14 placed on the top end of the slide column 13. The slider 12 is slidable along the axis of the chuck pin 11 of the rotary chuck 10 on the base 3 and fixed when needed.

The slide column 13 stands on the slider 12. The rotary chuck 14 being a thick circular plate is attached to an output of the drive motor and coaxial with the chuck pin 11 of the rotary chuck 10 of the fixed holder 7. A chuck pin 15 stands coaxially on the middle of the rotary chuck 14.

In the holder unit 4 the develop sleeve 132 is set between the chuck pins 11, 15 while the fixed holder 7 and the slide holder 8 are separate from each other. By moving the slide holder 8 closer to the fixed holder 7, the chuck pins 11, 15 are inserted into the develop sleeve 132 and the slider 12 is fixed. Thereby, the develop sleeve 132 is held by the holder unit 4 for forming the depressions 139.

The drive motor is provided at the top end of the slide column 13 of the slide holder 8 and rotates the rotary chuck 14 to rotate the develop sleeve 132 between the chuck pins 11, 15.

The tool mover 5 comprises a linear guide 16 and a not-shown actuator. The linear guide 16 includes a rail 17 which is linearly placed on the base 3 and longitudinally parallel to the axis of the develop sleeve 132 held between the chuck pins 11, 15, and a slider 18 which is movable on the rail 17.

The actuator is mounted on the base 3 to slide the slider 18 along the axis of the develop sleeve 132.

The tool 6 includes a columnar body 19, a tool motor 20, and an end mill 21 as a rotary tool. The body 19 stands on the slider 18.

Figure 6B:
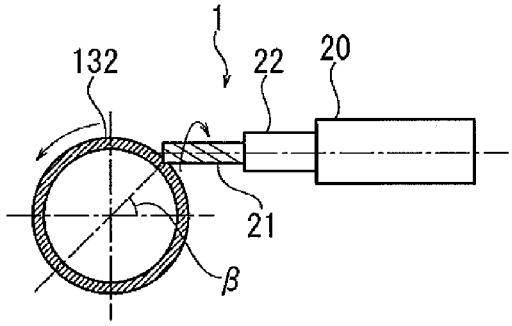
FIG. 6B is a cross section of the same along a VIIIB to VIIIB line in FIG. 6A.
Figure 6C:
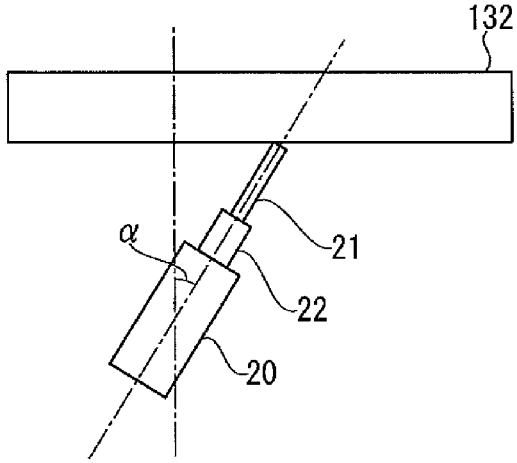
FIG. 6C is a top view of the same.

The tool motor 20 is provided on the top end of the body 19, and an output shaft 22 thereof protrudes to the develop sleeve 132 between the chuck pins 11, 15 and is parallel to the surface of the base 3 as shown in FIG. 6B. In FIG. 6C the axis of the output shaft 22 is intersected with the develop sleeve 132 in both of longitudinal direction and direction orthogonal to the longitudinal direction.

The end mill 21 as columnar is attached to the tip of the output shaft 22 of the tool motor 20 to protrude to the develop sleeve 132. The axis thereof is in parallel to the base 3 and intersects with the axis of the develop sleeve 132 and a direction orthogonal to the axis.

Figure 7A:
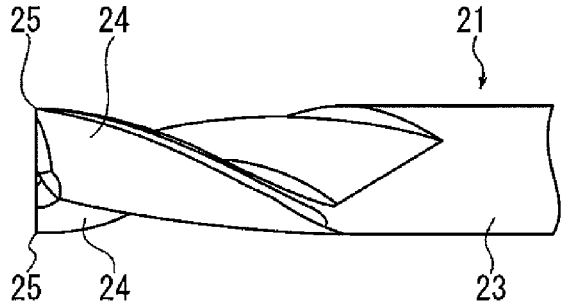
FIG. 7A is an enlarged view of an end mill in FIG. 6B.
Figure 7B:
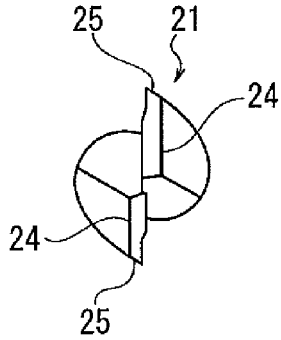
FIG. 7B is a front view of an end of the end mill in FIG. 7A.

In FIG. 7A the end mill 21 comprises a columnar body 23 and two cutting blades 24. The body 23 is attached to the tool body 19 and the cutting blades 24 are provided at one end of the body 23 with an interval in the circumferential direction. The cutting blades 24 helicoidally extend and protrude to the outer circumference of the end mill 21. The cross section of an outer edge 25 of the cutting blade makes a sharp angle with the developer sleeve 132 as shown in FIG. 6C.

In the tool 6 the tool motor 20 rotates the end mill 21 around the axis to form the depressions 139 on the surface of the develop sleeve 132.

The controller is a computer incorporating known RAM, ROM, CPU and else and connected with the drive motor, the actuator of the tool mover 5 and the tool motor 20 of the tool 6 to control the entire surface processing device 1.

To form a large number of depressions 139 on the develop sleeve 132, the controller controls the actuator to move the tool 6 along the axis (longitudinal direction) of the develop sleeve 132 while rotating the develop sleeve 132 and the end mill 21 with the drive motor and the tool motor 20. Along the rotation of the end mill 21, the cutting blades 24 intermittently cut the surface of the develop sleeve 132 and form a large number of the depressions 139.

The curvature radius of the depressions 139 in the longitudinal direction is defined by the curvature radius of the outer edge of the cutting blades 24, the depth of thereof is determined by a cutting amount of the cutting blades 24, and the interval between the depressions 139 in the longitudinal direction is determined by a moving speed of the tool 6. The controller controls the drive motor, the actuator of the tool mover 5 and the motor 20 of the tool 6 by the following expression:

$$N2=N1\times(n/2)/m \text{ where } n \text{ is an odd number}$$

wherein N1 is rotary velocity of the drive motor or the develop sleeve 132, m is the number of the cutting blades 24, and N2 is rotary velocity of the end mill 21.

The controller changes the elements of the expression to change the size or density of the depressions 139 arbitrarily to properly process the surface of the develop sleeve 132.

The controller is connected with various input devices as a keyboard and various display units.

Next, a process in which the develop sleeve 132 is produced by cutting the surface thereof with the surface processing device 1 will be described in the following.

First, the controller receives a part number and else of the develop sleeve 132 from an input device and moves the end mill 21 of the tool 6 to a start position or to one end of an unprocessed develop sleeve 132. The develop sleeve 132 is held by the holder unit 4 so that the develop sleeve 132 and the chuck pins 11, 15 are coaxial with each other.

Upon receiving an operation start instruction from the input device, the controller drives the drive motor, the actuator of the tool mover 5 and the tool motor 20 to rotate the end mill 21 and the cutting blades 24 to intermittently cut the surface of the develop sleeve 132. Thereby, the depressions 139 are formed on the develop sleeve 132.

Since the drive motor, the actuator and the tool motor 20 are driven concurrently, the end mill 21 and the develop sleeve 132 are relatively moved in the longitudinal direction of the develop sleeve 132 to form the depressions 139 while the develop sleeve 132 is intersected with the end mill 21 (orthogonally in the drawing) and rotated around the axis.

It is made possible to adjust the longitudinal inclination angle θ1 of the depressions 139 in FIG. 4A and the positions of the bottoms 139*a* thereof in the width and longitudinal directions in FIG. 4B, 4C, respectively by changing the position of the end mill 21 relative to the develop sleeve 132. Specifically, the inclination angle θ1 is increased by increasing the inclination angle α (FIG. 4C) of the axis of the end mill 21 relative to a direction orthogonal to the longitudinal direction of the develop sleeve 132 to separate the bottom 139*a* of the depression 139 away from the center in the longitudinal direction. Likewise, the bottom 139*a* is separated away from the center in the width direction by decreasing the inclination angle β (FIG. 6B) of the axis of the end mill 21 relative to the normal direction of the develop sleeve 132.

When the end mill 21 completes cutting the surface of the develop sleeve 132 at the end position or the other end of the develop sleeve 132, the drive motor, actuator, and tool motor 20 stop operating. The develop sleeve 132 with a large number of depressions 139 on the surface (FIG. 2) is removed from the chuck pins 11, 15 after the slide holder 8 is separated from the fixed holder 7. Then, a new develop sleeve is set in the holder unit 4. Abrasion or protuberance arising from the forming the depressions can be polished with a tape or a brush.

Next, a develop unit 113 incorporating the develop roller 115 is described with reference to FIG. 8. In the drawing the develop unit 113 comprises the develop roller 115, a develop supply unit 114, a housing 125, and a doctor blade 116.

The developer supply unit 114 comprises a container 117 and a pair of agitation screws 118. The container 117 is in a box shape in a length almost equal to the length of photoreceptor drum 108 in an axial direction and includes a partition 119 extending in a longitudinal direction to divide inside of the container 117 into a first area 120 and a second area 121. The first and second area 120, 121 communicate with each other.

The container 117 contains developer including magnetic carrier (magnetic powder) and toner in the first and second areas 120, 121. Toner is supplied to one end of the first area in a longitudinal direction when needed and it is fine spherical particles manufactured by emulsion polymerization method or suspension polymerization method. It can be made by pulverizing a synthetic resin lump in which various dyes or pigments are mixed and dispersed or other pulverizations. The average particle size of the toner is 3 μm or more and 7 μm or less.

Magnetic carrier is contained in the first and second area 120, 121 and the average particle size thereof is 20 μm or more and 50 μm or less.

The agitation screws 118 are accommodated in the first and second area 120, 121, respectively. The agitation screws 118 are in parallel to the container 117, the develop roller 115 and the photoreceptor drum 108 in the longitudinal direction. The agitation screws 118 are rotated around the axis to deliver the developer 126 while agitating the toner and magnetic carrier.

Figure 8:
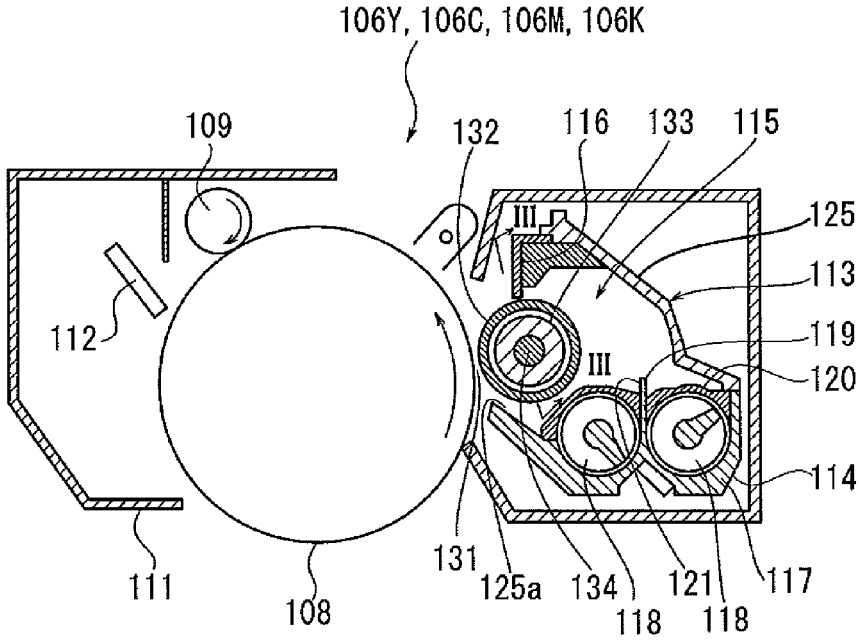
FIG. 8 cross sectionally shows a process cartridge incorporating the develop sleeve in FIG. 1.

In FIG. 8 the agitation screw 118 in the first area 120 delivers the developer 126 from one end to the other in the longitudinal direction and the agitation screw 118 in the second area 121 delivers it oppositely.

Thus, the developer supply unit 114 agitates toner supplied from one end of the first area 120 with magnetic carrier and delivers it to the other end and to the second area 121. It further agitates the toner and magnetic carrier in the second area 121 and supplies it to the surface of the develop roller 115.

The housing 125 in a box shape is attached to the container 117 of the developer supply unit 114 to cover the container 117, the develop roller 115 and else. It includes an opening 125*a* at a portion facing the photoreceptor drum 108.

The develop roller 115 being columnar is placed between the second area 121 and the photoreceptor drum 108 near the opening 125*a* in parallel to the photoreceptor drum 108 and the container 117. There is a gap between the develop roller 115 and the photoreceptor drum 108 facing each other. The gap forms a develop area 131 in which an electrostatic latent image is developed by attracting the toner in the developer 126 and a toner image is generated.

The doctor blade 116 is provided at an end of the develop unit 113 closer to the photoreceptor drum 108, and attached to the housing 125 with a distance from the outer face of the develop sleeve 132. It adjusts an amount of the developer 126 on the develop sleeve 132 to a desired amount by partially removing it in the container 117.

In the develop unit 113 the developer supply unit 114 sufficiently agitates the toner and the magnetic carrier and the developer is attracted onto the outer face of the develop sleeve 132 by the fixed magnetic poles. Along with the rotation of the develop sleeve 132, the developer attracted by the fixed magnetic poles are delivered to the develop area 131. The developer of a desired amount adjusted by the doctor blade is attracted onto the photoreceptor drum 108. Thus, the developer is held on the develop roller 115 and delivered to the develop area 131 to develop an electrostatic latent image on the photoreceptor drum 108 and generate a toner image.

Then, used developer 126 is dropped in the container 117, accumulated and agitated with unused developer again in the second area 121 and used for developing an electrostatic latent image on the photoreceptor drum 108. When a not-shown toner density sensor detects a decrease in toner density supplied to the photoreceptor drum 108, a not-shown toner supply controller starts operating to supply toner from a not-shown toner container.

A process cartridge incorporating the develop unit 113 is described. As shown in FIG. 8, the process cartridges 106Y, 106M, 106C, 106K each comprise a cartridge case 111, a charge roller 109, the photoreceptor drum 108, a cleaning blade 112, and the develop unit 113.

The cartridge cases 111 detachable from a body 102 of a later-described image forming apparatus 101 each contain the charge roller 109, photoreceptor drum 108, cleaning blade 112, and develop unit 113. The charge rollers 109 evenly charge the surfaces of the photoreceptor drums 108 placed with an interval from the develop rollers 115. An electrostatic latent image is formed on the photoreceptor drums 108 cylindrical and rotatable by the laser write units 122Y, 122M, 122C, 122K. Toner is attracted to the electrostatic latent image to thereby generate a toner image. The toner image is transferred onto the paper sheet 107 on the transfer belt 129. The cleaning blades 112 remove remnant toner from the photoreceptor drums 108 after the transfer of the toner image to a paper sheet 107.

Figure 9:
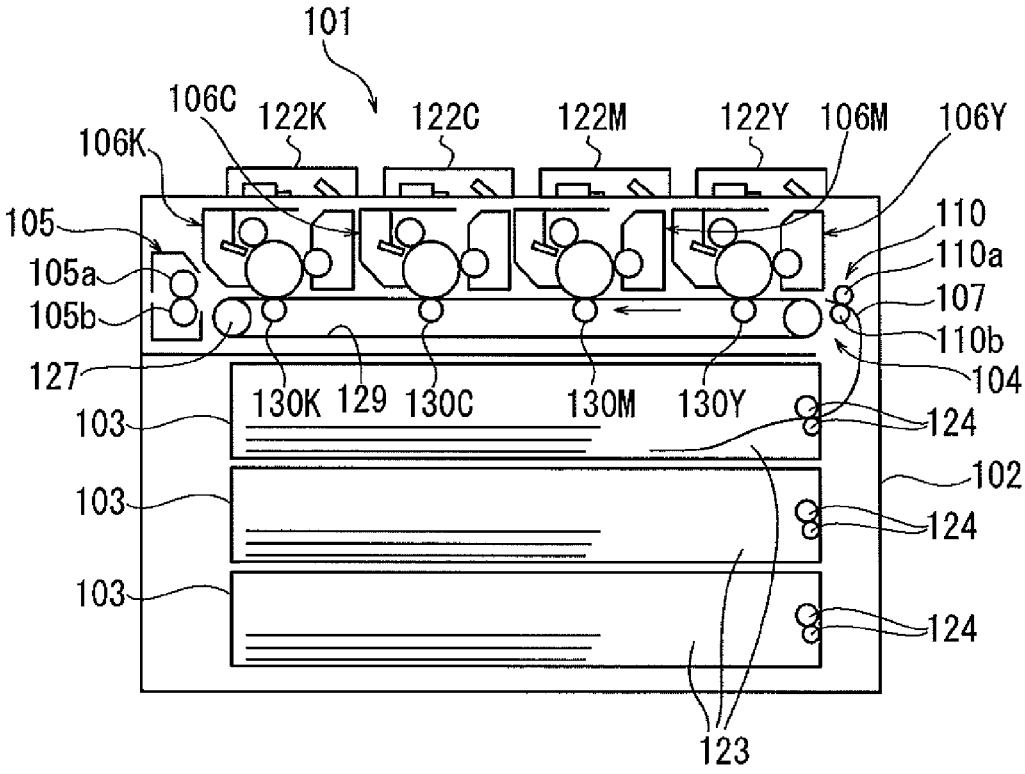
FIG. 9 is a front view of an image forming apparatus incorporating the process cartridge in FIG. 8.

The image forming apparatus 101 incorporating the process cartridges 106Y, 106M, 106C, 106K is described with reference to FIG. 8. It is configured to generate a full color image of yellow (Y), magenta (M), cyan (C), black (K) on a sheet of paper 107 (FIG. 9). Herein, units associated with these colors are given numeric codes with Y, M, C, K at the end.

The image forming apparatus 101 in FIG. 9 comprises a body 102, paper feeder units 103, a resist roller pair 110, a transfer unit 104, a fuse unit 105, four laser write units 122Y, 122M, 122C, 122K and the four process cartridges 106Y, 106M, 106C, 106K.

A box-like body 102 for example is placed on the floor or the like and contains the paper feeder units 103, resist roller pair 110, transfer unit 104, fuse unit 105, laser write units 122Y, 122M, 122C, 122K, and process cartridges 106Y, 106M, 106C, 106K.

The paper feeder units 103 are provided at the bottom of the body 102 to contain a pile of paper sheets 107, and comprise detachable paper cassettes 123 and feed rollers 124. The feed rollers 124 feed the topmost paper sheets 107 to between the later-described transfer belt 129 of the transfer unit 104 and photoreceptor drums 108 of develop units 113 of the process cartridges 106Y, 106M, 106C, 106K.

The resist roller pair 110, rollers 110*a*, 110*b*, is provided on a carrier path of the paper sheet 107 from the paper feeder units 103 to the transfer unit 104. The rollers 110*a*, 110*b* hold a paper sheet 107 between them and transmit it to between the transfer unit 104 and the process cartridges 106Y, 106M, 106C, 106K at a timing when a toner image is formed.

The transfer unit 104 is provided above the paper feeder units 103 and comprises a drive roller 127, a driven roller 128, a transfer belt 129, and transfer rollers 130Y, 130M, 130C, 130K. The drive roller 127 is placed downstream of a delivery direction of the paper sheet 107 and rotated by a motor or the like. The driven roller 128 is rotatably supported by the body 102 and placed upstream of the delivery direction of the paper sheet 107. The transfer belt 129 is a loop and extends around the drive roller 127 and the driven roller 128. By rotation of the drive roller 127, the transfer belt 129 endlessly rotates counterclockwise in the drawing.

The paper sheet 107 on the transfer belt 129 is carried between the transfer rollers 130Y, 130M, 130C, 130K and the photoreceptor drums 108 of the process cartridges 106Y, 106M, 106C, 106K and toner images on the photoreceptor drums 108 are transferred onto the paper sheet 107. The transfer unit 104 transmits the paper sheet 107 having the toner image thereon to the fuse unit 105.

The fuse unit 105 is provided downstream of the delivery direction of the paper sheet 107, and comprises a roller pair 105*a*, 105*b* to press and apply heat to the paper sheet 107 sent from the transfer unit 104 to fuse the toner image on the paper sheet 107.

The laser write units 122Y, 122M, 122C, 122K are provided above the body 102 in association with the process cartridges 106Y, 106M, 106C, 106K to irradiate with laser the photoreceptor drums 108 uniformly charged by the charge rollers 109 and generate an electrostatic latent image.

Next, image generation of the image forming apparatus 101 is described. First, the photoreceptor drum 108 is rotated and evenly charged with the charge roller 109 at −700V. Then, the photoreceptor drum 108 is exposed with laser and a voltage of an image portion thereon turns to −150V to generate an electrostatic latent image. The electrostatic latent image is applied with a bias voltage of −550V and developed in the develop area 131 by attracting toner of the developer 126 from the develop sleeve 132 of the develop unit 113. Thus, a toner image is generated on the photoreceptor drum 108.

The toner image is transferred onto the paper sheet 107 fed by the feed roller 124 and else between each photoreceptor drum 108 and the transfer belt 129. The fuse unit 105 fuses the toner image to generate a color image on the paper sheet 107.

Remnant toner T on the photoreceptor drum 108 is recovered by the cleaning blade 112. The toner-free photoreceptor drum 108 is neutralized by a not-shown neutralizer for the next image generation.

The image forming apparatus 101 performs a process control to prevent a variation in image quality due to environmental or temporal change. Specifically, it comprises a not-shown optical sensor detecting image density of a toner pattern which is formed on the photoreceptor drum 108 under a condition that a bias voltage is constant, to detect develop performance of the develop unit 113 from a density change. A target toner density is changed to adjust the develop performance to a preset target performance, thereby maintaining constant image quality. For example, when the detected image density of a toner pattern is lower than a target toner density, a not-shown controller (CPU) controls a not-shown toner supply controller to supply toner from a not-shown toner container and increase the toner density. When the detected image density is higher than the target toner density, the CPU controls the drive circuit to decrease the toner density. The toner density is detected by a not-shown toner density sensor. The image density of the toner pattern on the photoreceptor drum 108 may slightly vary because of a periodic unevenness in the image density caused by the develop sleeve 132.

According to the develop roller 115 in the present embodiment, the depressions 139 are arranged on the develop sleeve 132 such that the depressions 139 are intersected with the develop sleeve 132 in the longitudinal direction. In comparison with later-described first and second examples in which the depressions are parallel to the developer 132 in the longitudinal direction, the centers of the depressions 139 in which a larger amount of developer 126 is received can be arranged more densely in the longitudinal direction. This makes it possible to prevent generation of images with uneven density. In addition, it is able for the develop sleeve 132 to further prevent slippage of the developer 126 by the depressions 139 and attract the developer more efficiently by forming the depressions 139 so that the depth thereof is deeper in the downstream side than the upstream side relative to the rotary direction of the develop sleeve 132. Moreover, since amount of abrasion in the depression 139 in long-time use is larger in the upstream side than in the downstream side, the depression 139 whose upstream side is shallower than downstream side is unsusceptible to abrasion over time, preventing a decrease in delivery amount of developer of the develop roller.

Further, in the develop roller 115, the depressions 139 are arranged so that the shallow circumferences and the deep center portions thereof are alternated in the circumferential direction of the develop sleeve 132. This helps the developer roller evenly attracting the developer and prevents generation of images with uneven density. It is also able to attract or separate the developer more efficiently.

Further, in the develop roller 115 the depressions 139 are inclined at 90 degrees or less relative to the develop sleeve 132 in the longitudinal direction and a difference in the depth of the depressions 139 in the circumferential direction is sharp. This realizes the develop roller 115 with a good developer attraction and separation performance to prevent generation of images with density unevenness due to a degradation over time. The depressions 139 can be also arranged such that the centers of the depressions in which a larger amount of the developer 126 is received are positioned more densely in the longitudinal direction. Note that the closer to 90 degrees the inclination of the depressions 139 to the length of the develop sleeve 132, the better the developer attraction and separation performance. In the present embodiment, however, the inclination of the depressions 139 is set to about 60 degrees with the arrangement thereof in the circumferential direction taken into account. At inclination of 90 degrees or less the depressions 139 are not overlapped with each other in the circumferential direction.

Moreover, since the longitudinal cross sections of the depressions 139 are formed to be arc-like, a larger amount of the developer 126 can be contained in the depressions 139. Thus, the develop roller 115 can deliver sufficient amount of the developer 126 and contribute to generation of images with constant density.

Positions of depressions 139 adjacent to each other in the circumferential direction are shifted in the longitudinal direction of the develop sleeve 132 so that the centers of the depressions in which a larger amount of the developer 126 is received can be positioned more densely. Accordingly, the depressions 139 are uniformly formed on the entire surface of the develop sleeve 132. It is therefore able to evenly attract the developer onto the develop sleeve 132. Thus, the developer roller 115 contributes to preventing color unevenness of images and generation of images with constant density.

Moreover, in the develop roller 115, the depressions 139 are arranged helicoidally on the surface of the develop sleeve 132, which makes it possible to evenly attract the developer 126 on the develop sleeve 132. Thus, the developer roller 115 contributes to preventing color unevenness in images and maintaining constant image density.

Moreover, in the develop roller 115 the depressions can be regularly formed on the surface of the develop sleeve 132 easily and surely by cutting with the rotary tool 6 rotating around the axis. Thus, the developer roller 115 contributes to preventing color unevenness in images and maintaining constant image density.

Moreover, the depressions 139 can be regularly formed on the surface of the develop sleeve 132 without failure by moving the rotary tool 6 while rotating the develop sleeve 132 around the axis. Thus, the developer roller 115 contributes to preventing color unevenness in images and maintaining constant image density.

The develop unit 113, process cartridges 106Y, 106M, 106C, 106K, and image forming apparatus 101 each incorporate the above develop roller 115 so that they can prevent a decrease in the delivery amount of the developer 126 due to a degradation with time as well as color unevenness in images.

In general, with the deep depressions 139, an electric field between the develop sleeve 132 and a portion of the photoreceptor drum 108 opposite to the develop sleeve 132 is weakened, resulting in a decrease in the develop performance and develop density. For example, with depressions 139 in the same depth in width and longitudinal directions, along with rotation of the develop sleeve 132, portions in high electric field and low electric field, that is, with high and low develop performance, alternatively appear in the circumferential direction, causing uneven pitch. According to the image forming apparatus 101, the depression 139 is designed that it gets deeper from one end to the bottom in the width and longitudinal directions and then gradually gets shallower after the bottom. Thereby, the electric field between the develop sleeve 132 and a portion of the photoreceptor drum 108 opposite to the develop sleeve 132 gradually changes, evenly attracting the developer and preventing color unevenness in an image. The image forming apparatus 101 can exert excellent developer attraction and separation performance. Especially, according to the present embodiment, a color image forming apparatus which can generate high-quality color images with a high area rate at a constant density is realized.

Further, not protrusions formed by sandblasting but the depressions 139 of a larger size are formed on the surface of the develop sleeve 132. Therefore, the depressions 139 are unlikely to be abraded over time, preventing a decrease in the delivery amount of the developer 126.

Further, it is easy to set a processing condition for regular arrangement of the depressions 139 in order to hold an optimum amount of the developer 126 to attract and elongate the longetivity thereof. The depressions 139 can be formed by a set processing condition without failure and exceeds in processability.

The total volume of the regularly arranged depressions 139 is 0.5 $mm^3$ or more per area of 100 $mm^2$ on the surface of the develop sleeve 132. This can assure sufficient developer delivery performance of the develop roller.

Further, regularly arranging the depressions 139 in the same shape and size makes it possible to prevent unevenness in delivery of the developer, and setting the number of the depressions 139 arranged at 1.0 or more per 1 mm on the surface of the photoreceptor drum 108 in the circumferential direction. That is, plural depressions 139 are always positioned in the develop area 131, which makes it possible to prevent slippage of the developer 126 in the develop area 131.

Figure 10A:
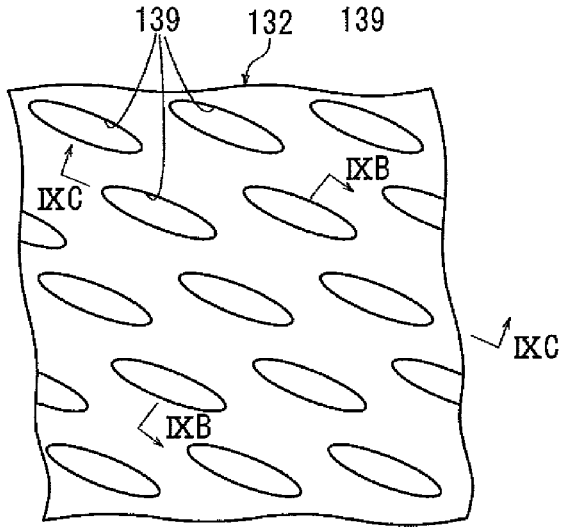
FIG. 10A is an enlarged view of a part of the surface of another example of the develop sleeve in FIG. 4A.
Figure 10B:
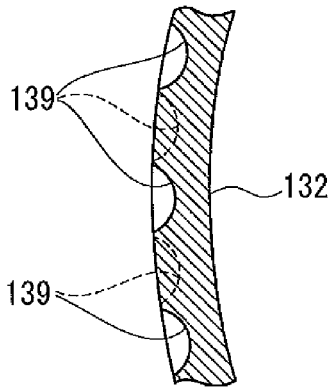
FIG. 10B is a cross section of the same along a IXB to IXB line in FIG. 10A.
Figure 10C:
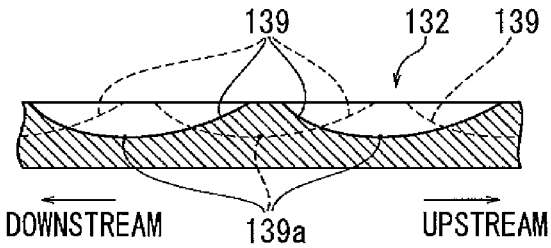
FIG. 10C is a cross section of the same along a IXC to IXC line in FIG. 10A.
Figure 11:
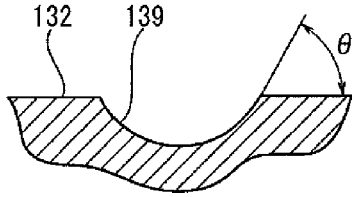
FIG. 11 is an enlarged view of a part of the surface in FIG. 10B.
Figure 12:
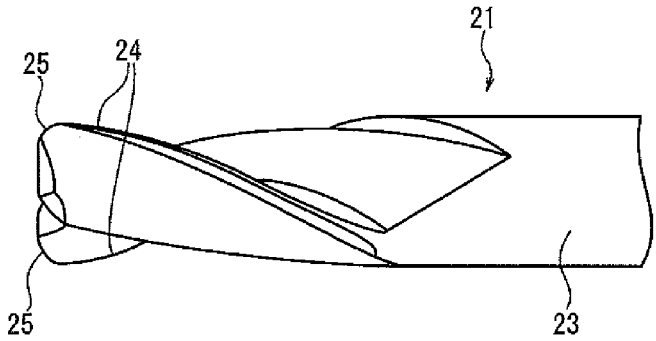
FIG. 12 is an enlarged side view of an end mill to form depressions on the surface of the develop sleeve in FIG. 10A.

According to the present embodiment, the cross sections of the depressions 139 in the circumferential direction (Y1) of the develop sleeve 132 are V-form. Alternatively, they can be formed arc-like as shown in FIGS. 10A to 10C. The drawings show arc-like cross sections thereof in both width and longitudinal directions for example. They are formed by the cutting blades 24 of the end mill 21 whose outer edges are arc-like as shown in FIG. 12. It is preferable to form the depressions 139 so that the inner face of the circumferential cross section makes the angle θ (in FIG. 11) of 60 degrees or less with the surface of the develop sleeve 132 for the purpose of avoiding a difference in develop density affected by the magnetic poles.

Thus, the depressions 139 whose width and longitudinal cross sections are arc-like can contain a larger amount of the developer 126 and the develop roller having these depressions can sufficiently deliver the developer 126.

Figure 13:
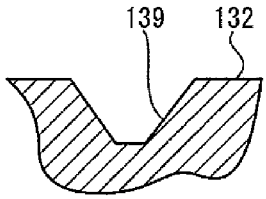
FIG. 13 cross-sectionally shows another example of a depression formed on the surface of the develop sleeve in FIG. 4B.
Figure 14:
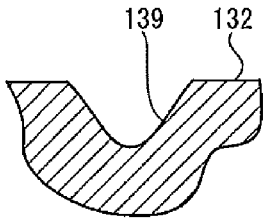
FIG. 14 cross-sectionally shows another example of a depression formed on the surface of the develop sleeve in FIG. 4B.

According to the present embodiment, the cross sections of the depressions 139 in the width direction are in V-form. Alternatively, they can be differently formed when appropriate as shown in FIGS. 13, 14 by changing the shape of the outer edges of the cutting blades 24. FIG. 13 shows an example of the V-form depression 139 having a flat bottom while FIG. 14 shows the same having an arc-like bottom.

According to the present embodiment the depressions 139 adjacent to each other in the circumferential direction are shifted in position by almost half the length of the depressions 139. Alternatively, the positions thereof can be shifted by an arbitrary length such as ⅓, ¼ of the length of the depressions 139.

According to the present embodiment, the end mill 21 and the develop sleeve 132 are relatively moved in the longitudinal direction of the develop sleeve 132. Alternatively, at least one of them can be moved in the longitudinal direction.

The above embodiment has described an example of the image forming apparatus 101 comprising the process cartridges 106Y, 106M, 106C, 106K detachable from the body 102 each including the cartridge case 111, charge roller 109, photoreceptor drum 108, cleaning blade 112, and develop unit 113. However, the present invention should not be limited to such an example. The process cartridge has only to include the develop unit 113. Moreover, the image forming apparatus 1 has only to include the develop unit 113 and can exclude the process cartridges 106Y, 106M, 106C, 106K.

The inventors of the present invention produced several examples (first to sixth examples and two comparisons) of the develop sleeve 132 using the surface processing device 1 according to the present embodiment.

Figure 15A:
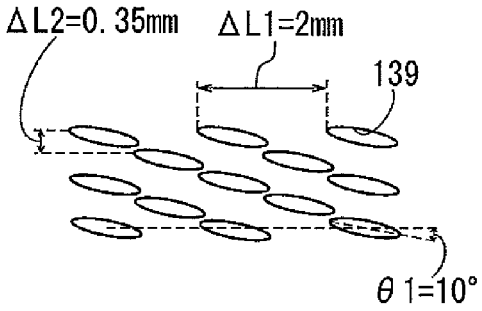
FIGS. 15A to 15F shows depressions on the surfaces of the first to sixth examples of the develop sleeve in FIG. 4A, respectively.

In a first example the end mill 21 in outer diameter of ϕ6 mm was used and rotated at 3,300 rpm and the rotary velocity of the develop sleeve 132 was 1,600 rpm. The surface processing device 1 was driven to move the end mill 21 at 2.0 m/rev in the longitudinal direction of the develop sleeve 132 to form depressions 139 made of aluminum in outer diameter of ϕ18 mm with an interval ΔL2 of 0.35 mm in the circumferential direction and an interval ΔL1 of 2.0 mm in the longitudinal direction as shown in FIG. 15A. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 10 degrees relative to an orthogonal direction to the longitudinal direction of the develop sleeve 132, to form the depressions 139 at inclination angle θ1 of 10 degrees relative to the longitudinal direction in FIG. 15A and with the bottom 139*a* shifted by 1/12 L (L is a length of the depression 139) from the longitudinal center. The magnet roller 133 was contained in the thus-processed develop sleeve 132 to complete the develop roller 115.

Figure 15B:
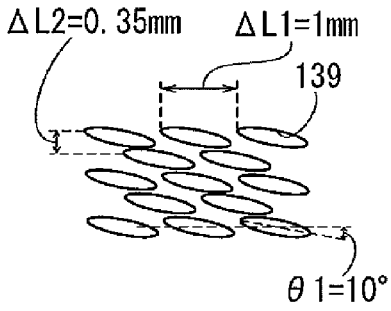

In a second example the end mill 21 in outer diameter of ϕ6 mm was used and rotated at 3,300 rpm and the rotary velocity of the develop sleeve 132 was 1,600 rpm. The surface processing device 1 was driven to move the end mill 21 at 1.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 1.0 mm in the longitudinal direction as shown in FIG. 15B. The cross section of the depression 139 in the width direction was formed to be an arc in curvature radius 0.3 mm and that in the longitudinal direction to be an arc in curvature radius 1.2 mm by the cutting blades 24, as in the first example.

Figure 16A:
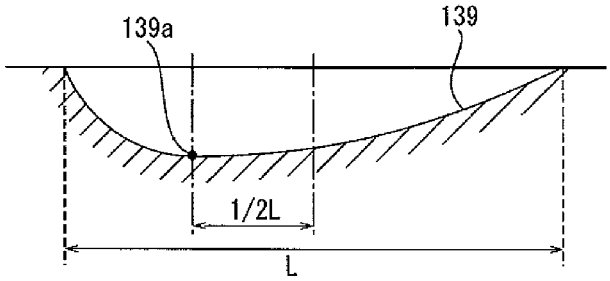
FIG. 16 cross-sectionally shows the depressions in the longitudinal direction on the surfaces of the first and second comparisons and first to sixth examples of the develop sleeve in FIG. 4B.
Figure 16B:
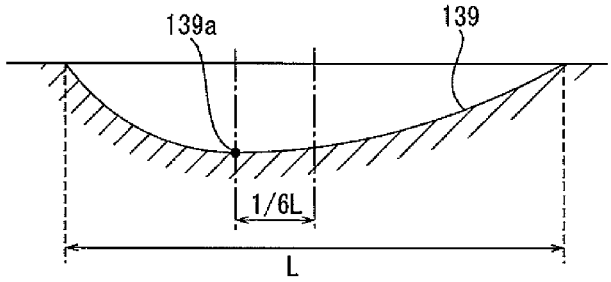
Figure 16C:
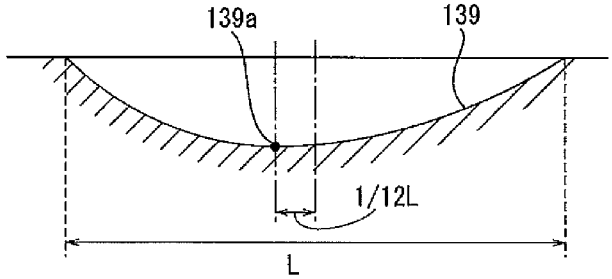

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 10 degrees relative to an orthogonal direction to the longitudinal direction of the develop sleeve 132, to form the depressions 139 at inclination angle θ1 of 10 degrees relative to the longitudinal direction in FIG. 15B and with the bottom 139*a* shifted by 1/12 L from the longitudinal center in FIG. 16C. The magnet roller 133 was contained in the thus-processed develop sleeve 132 to complete the develop roller 115.

Figure 15C:
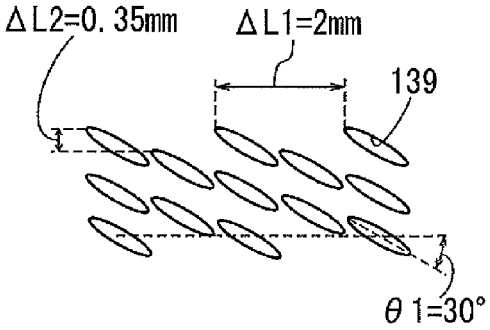

In a third example the end mill 21 in outer diameter of ϕ6 mm was used rotated at 3,300 rpm and the rotary velocity of the develop sleeve 132 was 1,600 rpm. The surface processing device 1 was driven to move the end mill 21 at 2.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 2.0 mm in the longitudinal direction as shown in FIG. 15C. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 30 degrees relative to an orthogonal direction to the longitudinal direction of the develop sleeve 132, to form the depressions 139 at inclination angle θ1 of 10 degrees relative to the longitudinal direction in FIG. 15C and with the bottom 139*a* shifted by 1/6 L from the longitudinal center in FIG. 16B. The magnet roller 133 was contained in the thus-produced develop sleeve 132 to complete the develop roller 115.

Figure 15D:
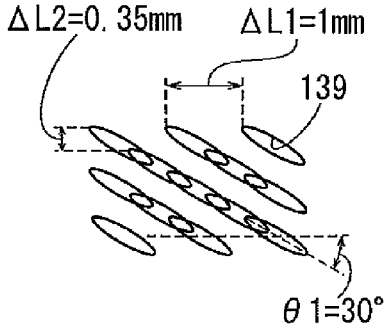

In a fourth example the end mill 21 in outer diameter of ϕ6 mm was used and rotated at 3,300 rpm and the rotary velocity of the develop sleeve 132 was 1,600 rpm. The surface processing device 1 was driven to move the end mill 21 at 1.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 1.0 mm in the longitudinal direction as shown in FIG. 15D. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 30 degrees relative to an orthogonal direction to the longitudinal direction of the develop sleeve 132, to form the depressions 139 at inclination angle θ1 of 30 degrees relative to the longitudinal direction in FIG. 15D and with the bottom 139*a* shifted by 1/6 L from the longitudinal center. The magnet roller 133 was contained in the thus-processed develop sleeve 132 to complete the develop roller 115.

Figure 15E:
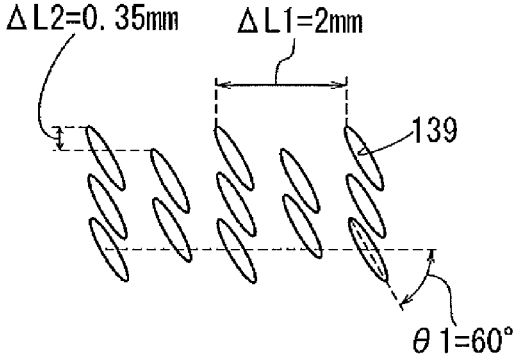

In a fifth example the end mill 21 in outer diameter of ϕ6 mm was used and rotated at 3,300 rpm and the rotary velocity of the develop sleeve 132 was 1,600 rpm. The surface processing device 1 was driven to move the end mill 21 at 2.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 2.0 mm in the longitudinal direction as shown in FIG. 15E. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 60 degrees relative to an orthogonal direction to the longitudinal direction of the develop sleeve 132, to form the depressions 139 at inclination angle θ1 of 60 degrees relative to the longitudinal direction in FIG. 15E and with the bottom 139*a* shifted by 1/4 L from the longitudinal center in FIG. 16A. The magnet roller 133 was contained in the thus-processed develop sleeve 132 to complete the develop roller 115.

Figure 15F:
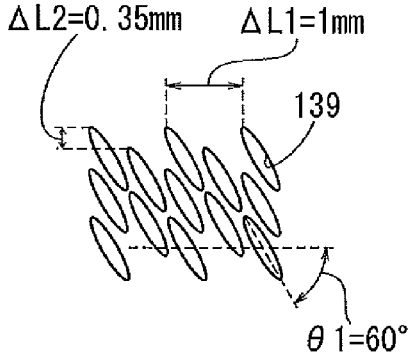

In a sixth example the end mill 21 in outer diameter of ϕ6 mm was used rotated at 3,300 rpm and the rotary velocity of the develop sleeve 132 was 1,600 rpm. The surface processing device 1 was driven to move the end mill 21 at 1.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 1.0 mm in the longitudinal direction as shown in FIG. 15F. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depressions 139 with the bottom 139*a* in the center of the width. As shown in FIG. 6C, the end mill 21 was placed so that the axis thereof was inclined at angle α of 60 degrees relative to an orthogonal direction to the longitudinal direction of the develop sleeve 132, to form the depressions 139 at inclination angle θ1 of 60 degrees relative to the longitudinal direction in FIG. 15F and with the bottom 139*a* shifted by 1/4 L from the longitudinal center in FIG. 16A. The magnet roller 133 was contained in the thus-processed develop sleeve 132 to complete the develop roller 115.

In a first comparison the end mill 21 in outer diameter of ϕ6 mm was used and rotated at 3,300 rpm and the rotary velocity of the develop sleeve 132 was 1,600 rpm. The surface processing device 1 was driven to move the end mill 21 at 2.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 2.0 mm in the longitudinal direction as shown in FIG. 17A. The cross section of the depression 139 in the width direction was formed to be an arc in curvature radius 0.3 mm and that in the longitudinal direction to be an arc in curvature radius 1.2 mm by the cutting blades 24.

Figure 16D:
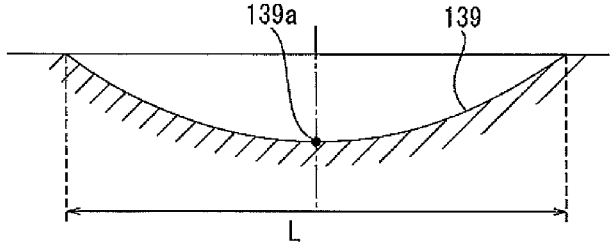
Figure 19:
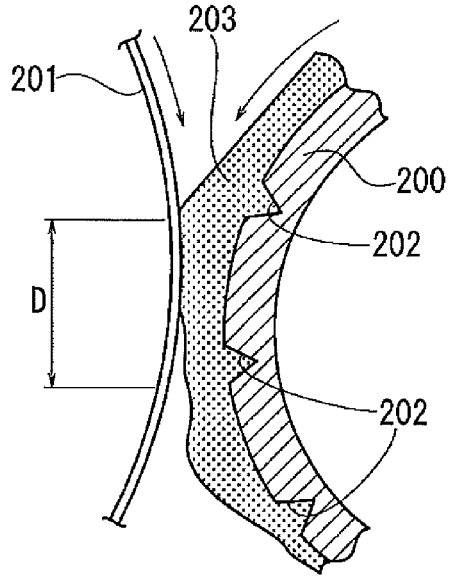
FIG. 19 shows a prior art develop sleeve attracting developer.
Figure 20:
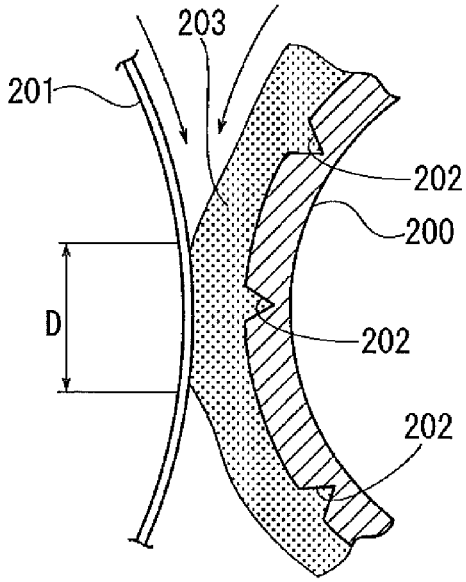
FIG. 20 shows another example of a prior art develop sleeve attracting developer.

As shown in FIG. 6B, the end mill 21 was placed so that the axis thereof was inclined at angle β of 45 degrees relative to the normal direction of the develop sleeve 132, to form the depression 139 with the bottom 139*a* in the center of the width. As shown in FIG. 6C, the end mill 21 was placed so that the axis thereof was inclined at angle α of 0 degree relative to an orthogonal direction to the longitudinal direction of the develop sleeve 132, to form the depressions 139 at inclination angle θ1 of 0 degree, that is, in parallel to the longitudinal direction in FIG. 17A and with the bottom 139*a* in the longitudinal center in FIG. 16D. The magnet roller 133 was contained in the thus-processed develop sleeve 132 to complete the develop roller 115.

In a second comparison the end mill 21 in outer diameter of ϕ6 mm was used and rotated at 3,300 rpm and the rotary velocity of the develop sleeve 132 was 1,600 rpm. The surface processing device 1 was driven to move the end mill 21 at 1.0 m/rev in the longitudinal direction of the develop sleeve 132 to form depressions 139 made of aluminum in outer diameter ϕ18 mm with an interval ΔL2 of 0.35 mm in the circumferential direction and an interval ΔL1 of 1.0 mm in the longitudinal direction as shown in FIG. 17B. The cross section of the depression 139 in the width direction was formed to be an arc in curvature radius 0.3 mm and that in the longitudinal direction to be an arc in curvature radius 1.2 mm by the cutting blades 24.

As shown in FIG. 6B, the end mill 21 was placed so that the axis thereof was inclined at angle β of 45 degrees relative to the normal direction of the develop sleeve 132, to form the depressions 139 with the bottom 139*a* in the center of the width. As shown in FIG. 6C, the end mill 21 was placed so that the axis thereof was inclined at angle α of 0 degree relative to an orthogonal direction to the longitudinal direction of the develop sleeve 132, to form the depressions 139 at inclination angle θ1 of 0 degree relative to the longitudinal direction in FIG. 17B and with the bottom 139*a* in the longitudinal center in FIG. 16D. The magnet roller 133 was contained in the thus-processed develop sleeve 132 to complete the develop roller 115.

The inventors conducted experiment using the image forming apparatus 101 incorporating the first to fifth examples and the first and second comparisons of the develop sleeve 132 to confirm their effects. The results of the experiment are shown in the table in FIG. 18.

In this experiment solid images were generated to check a decrease in image density and developer separation. The density of an image was measured at 6 points by a spectral densitometer to obtain a mean value. After 3,000,000 images in area rate of 5% were generated, the density of a solid image was measured and a decrease in density from the initial image was evaluated in 3 levels A to C. "A" indicates a decrease of 10% or less, "B" indicates a decrease of 15% or less, and "C" indicates a decrease of 15% or more. For developer separation, after 30 second operation, the top of the housing 125 was removed to check developer attachment on a developer separating portion. No developer attachment was evaluated as A, very little attachment as B and general attachment as C. Developer 126 used here was made of magnetic particles in mean volume particle size of 35 μm and toner in mean volume particle size of 5 μm. The magnetic particle includes a ferrite core and a resin coating layer containing charge adjusting agent. The toner was produced by emulsion polymerization and mainly composed of polyester mixed with charge adjusting agent and coloring agent and added with silica, titanium oxide and else. The developer was blended by a henschel mixer and toner density was adjusted to 7 st %. Process condition was surface potential on the photoreceptor at −700V, exposure potential at −150V, and develop bias at −550V. The first and second comparisons are not according to the present invention and produced for comparison.

As shown in the table of FIG. 18, using the first comparison of the develop sleeve 132 having depressions 139 longitudinally parallel to the length of the develop sleeve 132, there was slight unevenness in density of an initial image generated and a decrease in density of the solid image after generation of 3,000,000 images. Also, developer attachment occurred in the developer separating portion. As obvious from the results of the second comparison, with a narrow interval ΔL1 of the depressions 139, the initial image was a good image without density unevenness but a decrease in density of an image and slight developer attachment occurred after generation of 3,000,000 images.

To the contrary, using the develop sleeves of the first to sixth examples with the depressions 139 longitudinally intersecting with the length of the develop sleeve 132, the initial image was a good image with no density unevenness, and there was no decrease in density of image after generation of 3,000,000 images and no developer attachment.

According to the present embodiment the inclination angle θ1 of the depressions 139 is changed by changing the inclination angle α. Alternatively, the depressions in different depths can be produced by changing process condition without changing the inclination angle θ1.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A develop roller comprising:

a magnet roller; and a develop sleeve containing the magnet roller and comprising a plurality of depressions in an elliptic shape regularly arranged with an interval in a longitudinal direction on a surface onto which developer is attracted by a magnetic force of the magnet roller, wherein:

each elliptic-shaped depression amongst the plurality of depressions is configured such that a longitudinal direction of the elliptic-shaped depression is inclined at an angle of 10 degrees or greater relative to the longitudinal direction of the develop sleeve, and in a rotary direction of the develop sleeve, a downstream side of the elliptic-shaped depression is formed to be deeper than an upstream side of the elliptic-shaped depression.

2. A develop roller according to claim 1, wherein the depressions are arranged so that shallow portions and deep portions thereof are alternated in a circumferential direction of the develop sleeve.

3. A develop roller according claim 1, wherein a cross section of the depressions in a width direction is in V-form and that of the depressions in the longitudinal direction is arc-like.

4. A develop roller according to claim 1, wherein cross sections of the depressions in both width and longitudinal directions are arc-like.

5. A develop roller according to claim 1, wherein neighboring depressions on the develop sleeve in the circumferential direction are shifted in position from each other in the longitudinal direction.

6. A develop roller according to claim 1, wherein the depressions are arranged helicoidally on the surface of the develop sleeve.

7. A device for processing the develop roller according to claim 1, comprising:

a rotary tool rotatable around an axis and forming the depressions on the surface of the develop sleeve by cutting; and a driver rotating the rotary tool.

8. A device according to claim 7, wherein the rotary tool and the develop sleeve are relatively moved in the longitudinal direction of the develop sleeve to form the depressions while the develop sleeve is in a position to intersect with the axis of the rotary tool and rotated around the axis.

9. A develop unit comprising the develop roller according to claim 1.

10. A process cartridge comprising the develop unit according to claim 9.

11. An image forming apparatus comprising:

a photoreceptor drum;

a charge unit; and the develop unit according to claim 9.

* * * * *